United States Patent [19]

Pride

[11] Patent Number: 4,585,124

[45] Date of Patent: Apr. 29, 1986

[54] FOOD CONTAINER AND INSERT

[75] Inventor: Peter Pride, Hunters Hill, Australia

[73] Assignee: Gaichime Pty. Limited, Mississauga, Canada

[21] Appl. No.: 615,803

[22] Filed: May 31, 1984

[51] Int. Cl.[4] ..... B65D 75/58

[52] U.S. Cl. ..... 206/559; 206/525; 206/804; 229/11; 426/115

[58] Field of Search ..... 206/525, 559, 804; 229/7 SC, 11, 17 SC, 87 B, 87 F; 426/115, 124, 128

[56] References Cited

U.S. PATENT DOCUMENTS

| | | | |
|---|---|---|---|
| 2,377,120 | 5/1945 | Apfelbaum | 206/538 |
| 2,474,166 | 6/1949 | Rumsey, Jr. | 206/804 |
| 2,800,999 | 7/1957 | Frankenstein | 426/128 |
| 3,513,594 | 5/1970 | Hasselbach | 229/44 R |
| 3,671,271 | 6/1972 | Miller | 229/87 F |
| 3,835,994 | 9/1974 | Davis et al. | 426/128 |
| 4,197,940 | 4/1980 | Derossett | 426/128 |
| 4,264,629 | 4/1981 | Dogliotti | 426/115 |
| 4,269,316 | 5/1981 | Growney | 426/124 |

FOREIGN PATENT DOCUMENTS

| | | | |
|---|---|---|---|
| 0649590 | 9/1928 | France | 206/804 |
| 0679628 | 9/1952 | United Kingdom | 229/11 |

*Primary Examiner*—William Price
*Assistant Examiner*—Jimmy G. Foster
*Attorney, Agent, or Firm*—Donald E. Hewson

[57] ABSTRACT

A food container in the form of an elongate open-top box open at one end is provided with an insert of flexible material for positioning on the base of the container, the insert having a pull tab projecting at the open end of the container. A food item, such as a crepe, positioned on the insert can be removed from the container for consumption by pulling on the pull tab without having to handle the food item. The insert has ridges for frictional retention of the food item as it is withdrawn from the container, and a longitudinal strengthening groove.

3 Claims, 5 Drawing Figures

FOOD CONTAINER AND INSERT

BACKGROUND OF THE INVENTION

This invention relates to food container apparatus, particularly for serving ready-to-eat food items.

Some items of ready-to-eat food are served in a cardboard or like container substantially in the form of an open top box with an open end. An example of such a food item is a rolled crepe which may be served, ready to eat, in such a container. For the sake of convenience, the invention will be described in relation to crepes in particular, but it is to be understood that the invention is not limited thereto. Although boxes having an opening at one end are suitable for the serving of elongated food items, such as crepes, sausages, and food sticks, the manner of presentation is not wholly satisfactory from either the hygiene or the ease of eating standpoints, since it is generally necessary to handle the food item in order to remove it from the container for consumption.

It is an object of the present invention to provide apparatus for use in conjunction with food containers of the type referred to, which may obviate the need for having to handle the food item in order to remove and consume same.

STATEMENT OF PRIOR ART

The following U.S. patents relate to containers and the like for diverse consumer products. None of these patents however discloses the features of the present invention.

U.S. Pat. No. 2,248,843
U.S. Pat. No. 2,415,117
U.S. Pat. No. 3,355,082
U.S. Pat. No. 3,446,416
U.S. Pat. No. 4,264,629
U.S. Pat. No. 4,266,668

SUMMARY OF THE INVENTION

According to the invention, there is provided an insert or liner for a food container in the form of a box having an open end, the insert or liner comprising an elongate sheet of flexible material of such dimensions that it may be placed flat on the base of the container, the insert having longitudinal reinforcing means, such as a groove which is concave with respect to the upper surface of the sheet, for resisting a tendency of the free end of the insert to bend downwards when supported from the other end during insertion of the insert into the container, and frictional retention means, such as a plurality of transverse ridges, projecting upwardly from the upper surface of the sheet to be engaged by a food item in the container, so that when the insert is drawn from the container from the open end thereof, the food item will be withdrawn with the insert.

Throughtout this specification, the term "sheet of flexible material" embraces paper, waxed paper, plastic materials, or any combination thereof as well as other flexible materials which will accept and maintain grooves and ridges.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF PREFERRED EMBODIMENT

Figure 1:
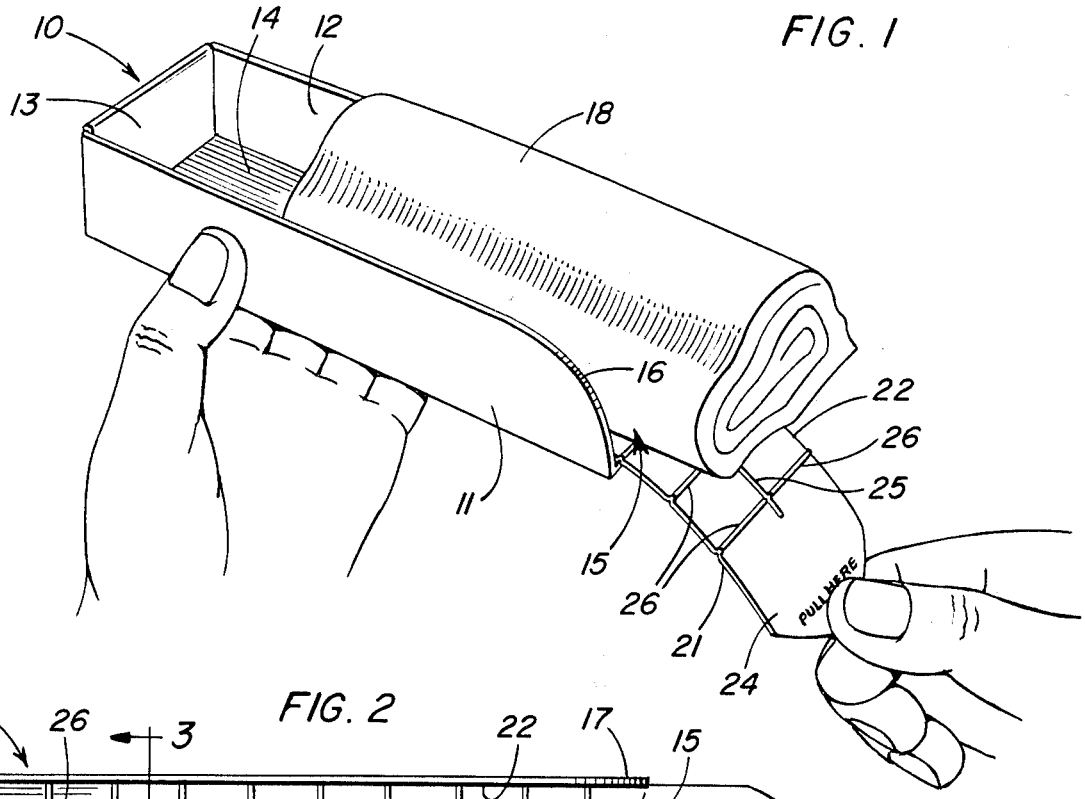
FIG. 1 is a perspective view of a food container having an insert therein according to one embodiment of the invention, and a food item on the insert, the insert being manually withdrawn from the container for consumption of the food item.
Figure 2:
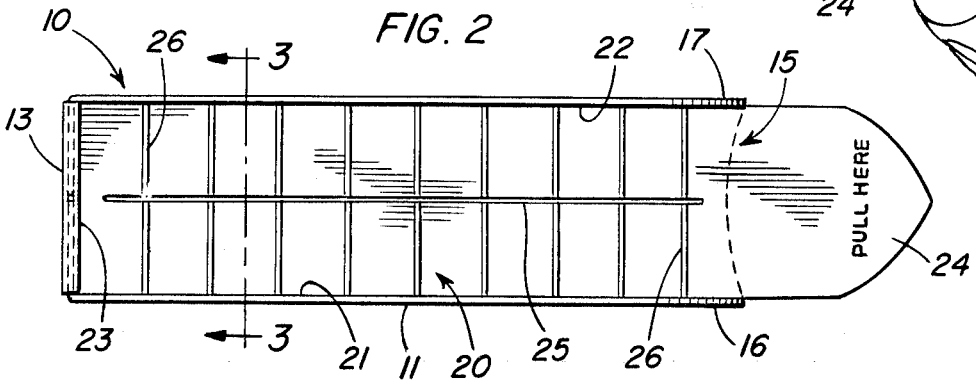
FIG. 2 is a plan view of the container and insert prior to placement of the food item on the insert.

A food container 10, shown in FIGS. 1 and 2, has side walls 11, 12, end wall 13, and a base 14. The end 15 of the container 10 is open, and is partly bounded by the curved ends 16, 17 of the side walls 11 and 12. If desired, the front edge of the base 14 may also be curved. The food container 10 is, in this instance, of an elongated form so as to make it suitable for receipt of a food item in the form of a crepe 18 as shown in FIG. 1. The crepe 18 is positioned in the container on a container insert 20 comprising a sheet of flexible material (as defined above) and which is positioned on the base 14 of the container for receipt of the crepe.

Figure 3:
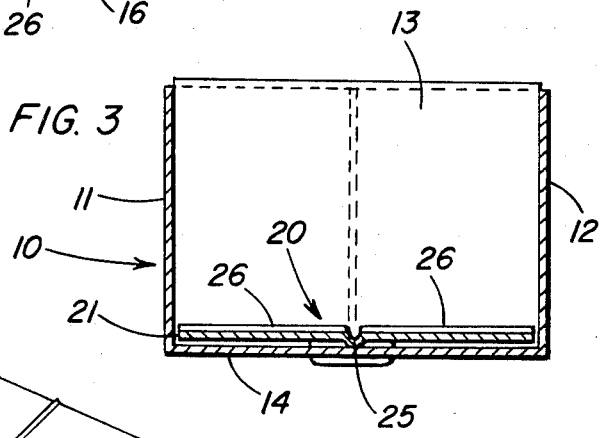
FIG. 3 is a sectional view on line 3—3 of FIG. 2.
Figure 4:
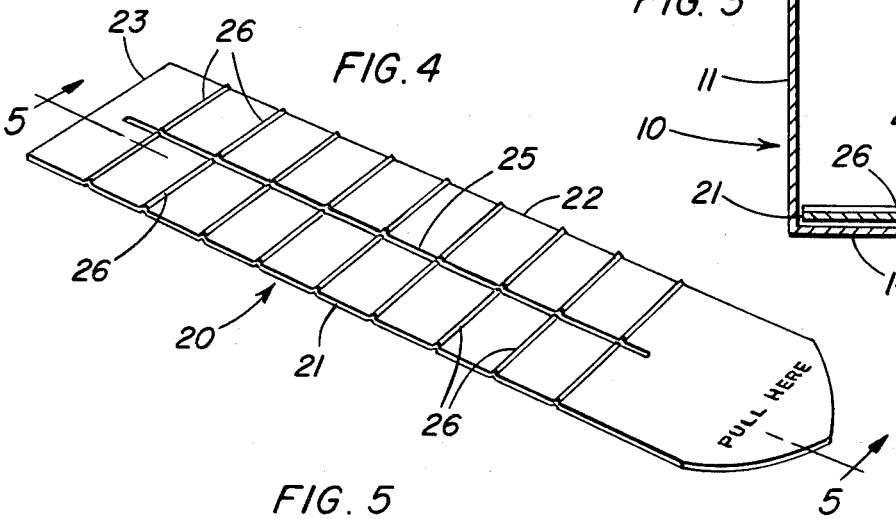
FIG. 4 is a perspective view of the container insert.
Figure 5:
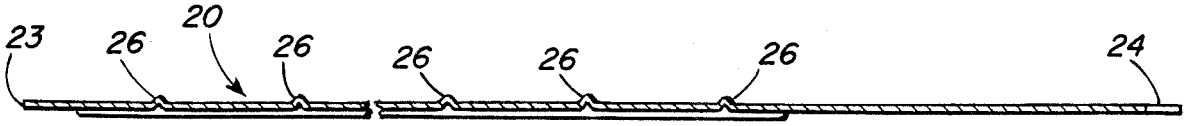
FIG. 5 is a sectional view on line 5—5 of FIG. 4.

Insert 20 has side edges 21, 22, a rear edge 23, and a curved front tab 24. Extending substantially along the central axis of the insert 20 is a groove 25, which is concave with respect to the upper surface of the insert, as can be seen in FIG. 3. Extending transversely of the groove 25 are ridges 26 projecting upwardly from the upper surface of the insert 20 as can be seen in FIG. 5. The width of the insert preferably conforms substantially to the width of the container, and its length may be somewhat longer than that of the container so that the tab end 24 may be accessible by projection thereof from the open end of the container. Alternatively, if the container base has a recess at the open end, the end of the insert may be flush with the end of the container, in which case the recess provides access to the tab end of the insert.

The purpose of groove 25 is to provide a measure of resistance against the tendency of the free end of the insert 20 to bend downwards while the insert is supported at the tab end 24, so as to assist the loading of the insert into the container 10. As the crepe 18 is usually served hot, its heat will tend to soften the material of the insert so as to reduce the strengthening effect of groove 25. Thus, when the insert 20 is withdrawn from the box, by pulling on the tab end, it may bend downwards away from the crepe 18 to facilitate consumption of the crepe. During withdrawal of the insert 20, the ridges 26 frictionally engage the crepe 18 so that as the insert 20 is drawn from the container, the crepe will be carried along with it.

It will be appreciated that use of a container and insert in accordance with the invention may obviate the need to handle the crepe as it is withdrawn from the container and consumed. Accordingly, use of the insert may improve the general hygiene of containers of the kind referred to.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An insert for a food container in the form of a box having an open end, said insert comprising a bendable elongated sheet of flexible material of such dimensions that it may be placed flat on the base of the container; a pull tab at one end of the insert which is accessible at and extends from said open end of the container; the insert having frictional retention means on an upper surface of the sheet to be engaged by an item of food in the container so that when the insert is withdrawn from the container by pulling on the tab, the food item will be withdrawn along with the insert;

where said frictional retention means comprises a plurality of transverse ridges projecting upwardly from the upper surface of the sheet, and a longitudinal groove which is concave with respect to the upper surface of the sheet, for resisting longitudinal bending of the insert when positioning the insert in a container;

whereby the insert may be bent in a curved shape as it is withdrawn from the container by being pulled on the pull tab.

2. The invention of claim 1 wherein the sheet is of a material which is softened by heat generated by a food item placed thereon whereby the resistance of the insert to bending is reduced.

3. In combination, a food container in the form of a box having an open end, and a container insert comprising a blendable sheet of flexible material positioned flat on the base of the container; a pull tab at the end of the sheet which is accessible at the open end of the container; the sheet having an upper surface provided with frictional retention means for retaining a food item thereon as the insert is removed from the container by pulling on the pull tab;

where said pull tab projects from the open end of the container; and where said frictional retention means comprises a plurality of transverse ridges on the upper surface of the sheet, and a longitudinal groove which is concave with respect to the upper surface of the sheet, for resisting longitudinal bending of the insert positioning the insert in the container;

whereby the insert may be bent in a curved shape as it is withdrawn from the container by being pulled on the pull tab.

* * * * *